US007007583B1

(12) United States Patent
Fiola

(10) Patent No.: US 7,007,583 B1
(45) Date of Patent: Mar. 7, 2006

(54) BAGEL CUTTER

(76) Inventor: Salvatore Fiola, 12 Valley Dr., Thiells, NY (US) 10984

( * ) Notice: Subject to any disclaimer, the term of this patent is extended or adjusted under 35 U.S.C. 154(b) by 0 days.

(21) Appl. No.: 10/612,228

(22) Filed: Jul. 2, 2003

Related U.S. Application Data

(60) Provisional application No. 60/394,111, filed on Jul. 6, 2002.

(51) Int. Cl.
*B26D 3/30* (2006.01)
*B26D 7/02* (2006.01)

(52) U.S. Cl. ..... 83/870; 83/454; 83/465; 83/762; 83/932; 269/87.2; 269/288; 269/295

(58) Field of Classification Search ..... 83/762–767, 83/454, 932, 452, 455, 464, 465, 466, 466.1, 83/761, 870; 269/87.1, 87.2, 87, 287, 288, 269/293, 295; D7/673, 674
See application file for complete search history.

(56) References Cited

U.S. PATENT DOCUMENTS

| | | | | | |
|---|---|---|---|---|---|
| 2,172,538 | A * | 9/1939 | Katzinger | 83/762 |
| 2,206,154 | A * | 7/1940 | Bixler | 83/762 |
| 3,018,806 | A * | 1/1962 | Moore | 83/451 |
| 4,249,445 | A * | 2/1981 | Browning | 83/762 |
| 4,399,989 | A * | 8/1983 | Baillie | 269/87.2 |
| 4,747,331 | A * | 5/1988 | Policella | 83/762 |
| D316,657 | S * | 5/1991 | Mulherin | D7/673 |
| 5,361,666 | A * | 11/1994 | Kensrue | 83/870 |
| 5,481,953 | A * | 1/1996 | McLeod | 83/762 |
| 5,611,266 | A * | 3/1997 | Kensrue | 83/762 |
| 5,638,734 | A * | 6/1997 | Fish | 83/762 |
| 5,927,701 | A * | 7/1999 | Chapman | 269/87.2 |
| 5,946,998 | A * | 9/1999 | Thompson | 83/762 X |
| 6,128,996 | A * | 10/2000 | Sato et al. | 83/765 |
| 6,202,529 | B1 * | 3/2001 | Hodsdon | 83/870 |
| 6,389,944 | B1 * | 5/2002 | Davidson | 83/762 |
| 6,474,210 | B1 * | 11/2002 | Nel et al. | 83/768 |

* cited by examiner

*Primary Examiner*—Clark F. Dexter
(74) *Attorney, Agent, or Firm*—Richard A. Joel

(57) ABSTRACT

A bagel slicing device for safely and effectively slicing bagels comprises a holder having a slotted base, upwardly extending end portions at each end of the base and side members attached to the base at their lower end and being pivotal about an edge to engage a bagel therebetween and extending between the end portions. The end portions include a knife slot which cooperates with the base slot to permit cutting a bagel completely through. The side members include gripping ribs on both surfaces thereof and the end portions include ribs to locate the bagel properly between the sides.

8 Claims, 3 Drawing Sheets

BAGEL CUTTER

CROSS REFERENCE TO RELATED APPLICATIONS

This application is based on provisional application 60/394,111 filed Jul. 6, 2002

BACKGROUND OF INVENTION

This invention relates to bagel holders and slicers. In particular, this invention discloses a one piece molded device which holds a bagel between flexible side members while permitting one to safely and evenly slice a bagel in an expeditious manner.

The prior art includes U.S. Pat. No. 6,543,322 to Skoko which discloses a cutting frame for holding a bagel to be sliced into two pieces. The guide member in the frame includes a knife slot in a structure, which is dissimilar from the present invention.

U.S. Pat. No. 6,532,864 to Ancona discloses a combination slicer and toaster while U.S. Pat. No. 6,474,210 to Nel discloses a bagel slicer having an annular body with a slot for movement of a knife having a handle extending externally of the slot.

Further bagel holders are shown in U.S. Pat. Nos. 6,389,944; 6,318,222; 6,244,153; 6,202,529; and, 6,186,038.

None of the above patents disclose the particular features which lend patentability to the present invention.

SUMMARY OF INVENTION

This invention relates to a bagel holder or cutter that permits slicing a bagel safely, evenly and with ease. The holder comprises a one piece molded structure which includes a base, spaced end portions extending vertically upward from the base and extending upward therefrom.

The end portions each include an opposing vertical slot which cooperates with an elongated slot in the base to accommodate a knife during slicing. The side members include a plurality of inwardly extending ribs which grip a bagel when the flexible side members are squeezed. The exterior surface of the side members includes a plurality of spaced ribs for gripping purposes. The end portions include triangular ribs extending downwardly to the base to center a bagel which is inserted into the holder between the sides.

In use, a bagel is simply inserted into the holder/cutter between the side members. The bagel slides into position guided by the triangular end ribs. A knife is positioned in the opposing slots with one hand. The side members are then squeezed with the other hand to firmly grip the bagel with the internal side ribs. The bagel is then sliced completely through evenly and safely, with the knife moving downwardly into the base slot. Releasing the side members permits removal of the sliced bagel.

Accordingly, an object of this invention is to provide a new and improved device for safely slicing bagels and the like.

Another object of this invention is to provide an inexpensive, reliable device for safely holding and slicing bagels.

A further object of this invention is to provide a new and improved device for holding bagels with flexible side members while a knife is guided by slots in the end portions and base of the device.

A more specific object of this invention is to provide a unique one piece molded device which includes end portions which guide a bagel into position between flexible gripping side members and each include a knife slot to guide a knife during slicing and cooperate with an elongated slot in a base to permit slicing the bagel completely through in a safe and expeditious manner.

BRIEF DESCRIPTION OF DRAWINGS

The above and other objects of this invention may be more clearly seen when viewed in conjunction with the accompanying drawings wherein.

FIG. 5 is a partial perspective view of the invention showing the inside thereof; and.

DETAILED DESCRIPTION

Figure 1:
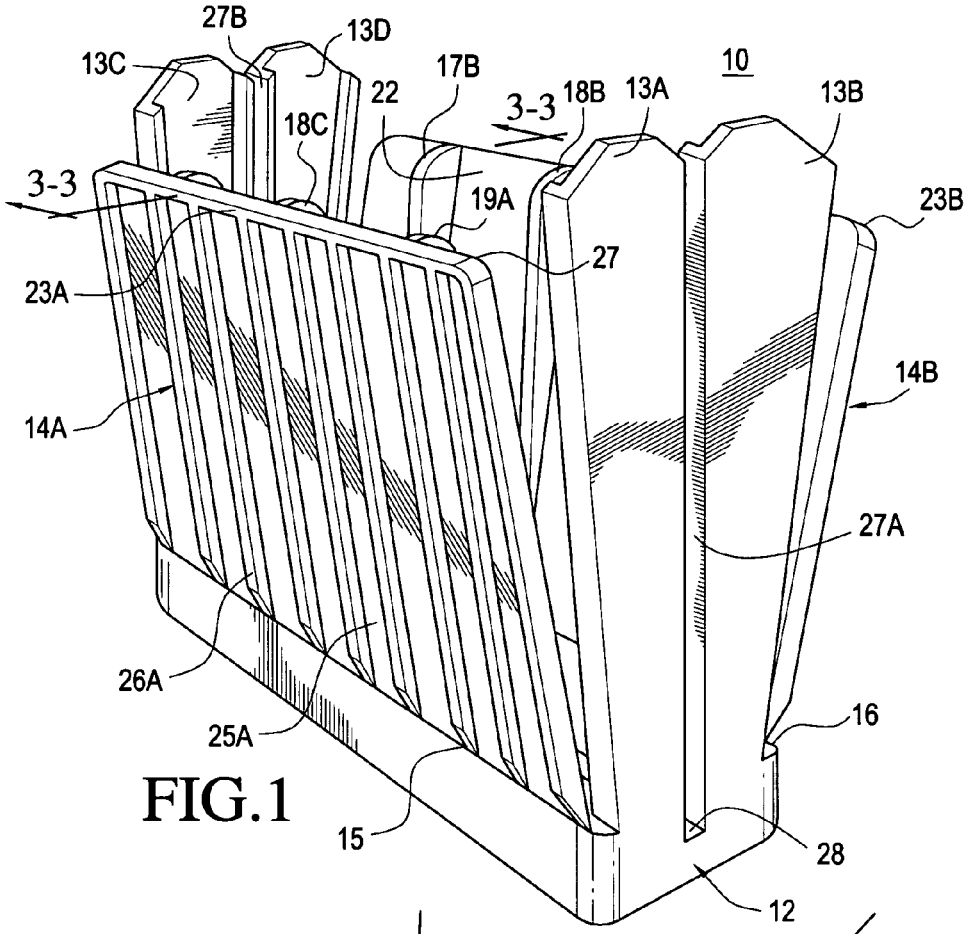
FIG. 1 is a perspective view of the invention.
Figure 2:
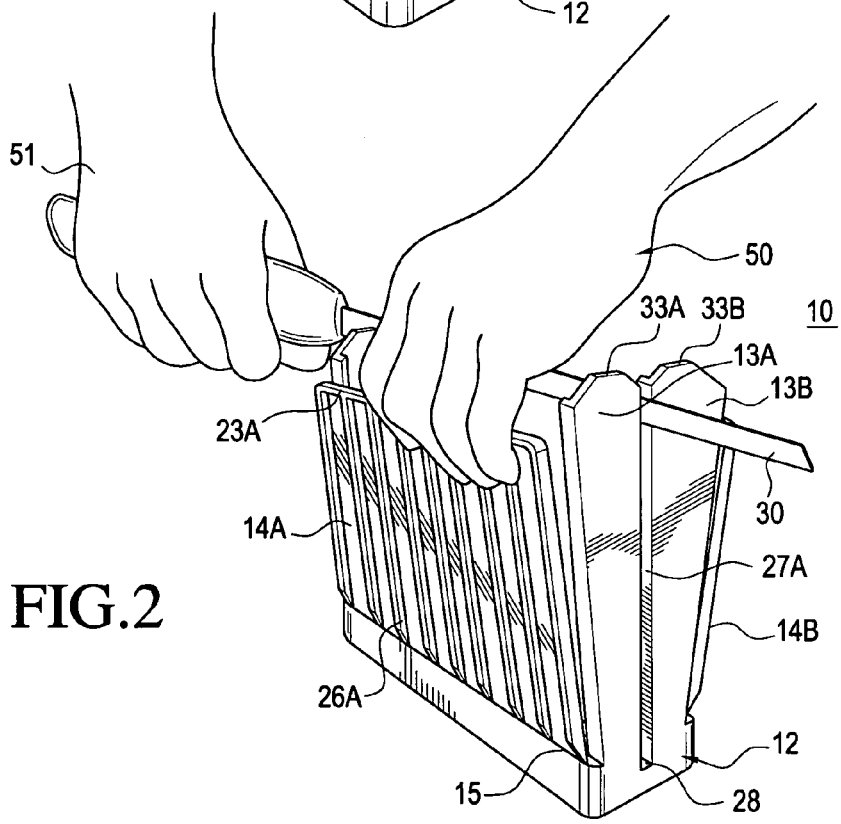
FIG. 2 is a perspective view of the invention in operation showing a bagel being cut.
Figure 3:
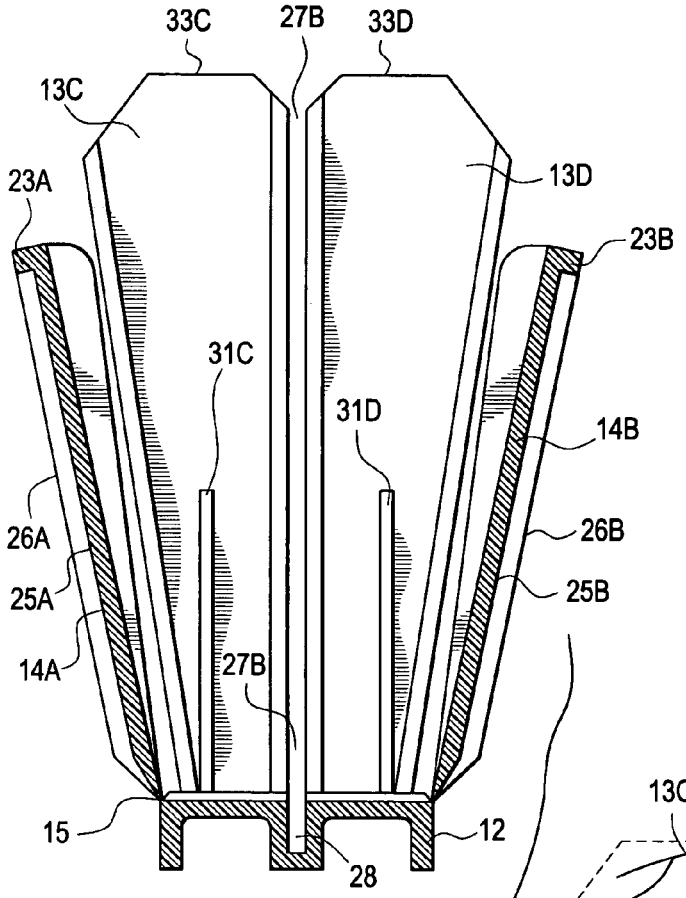
FIG. 3 is a cross-sectional end view of the invention taken along the line 3—3 of FIG. 1.
Figure 4:
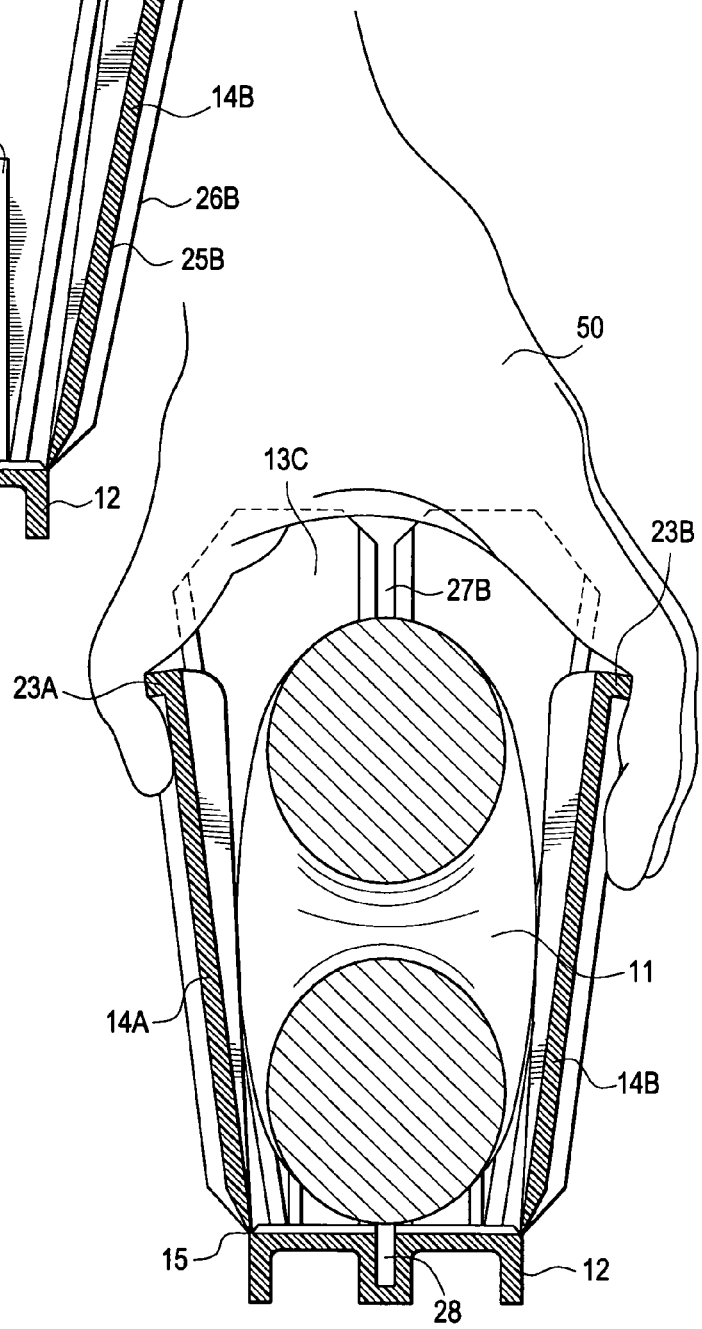
FIG. 4 is an end cross-sectional view of the invention with a bagel in position prior to slicing.
Figure 5:
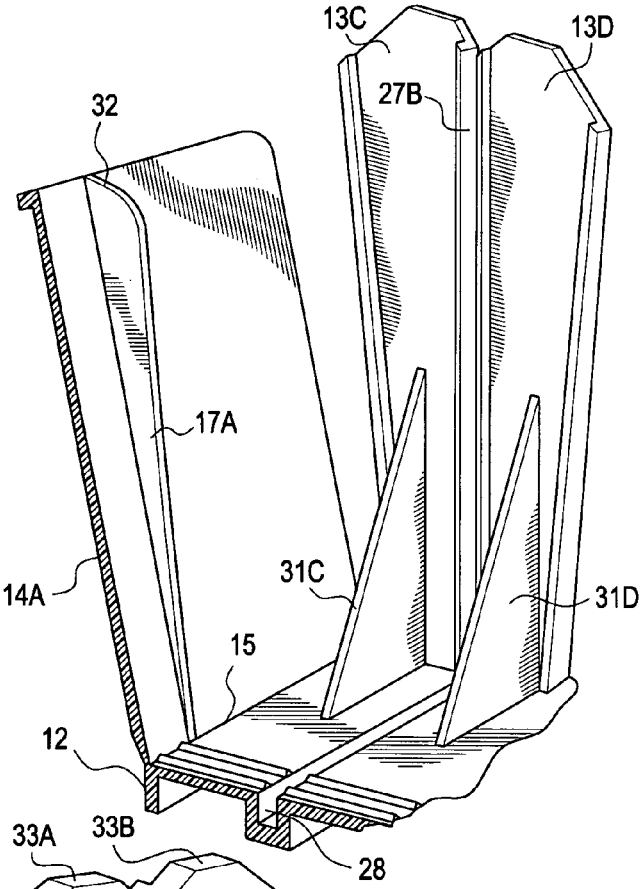
Figure 6:
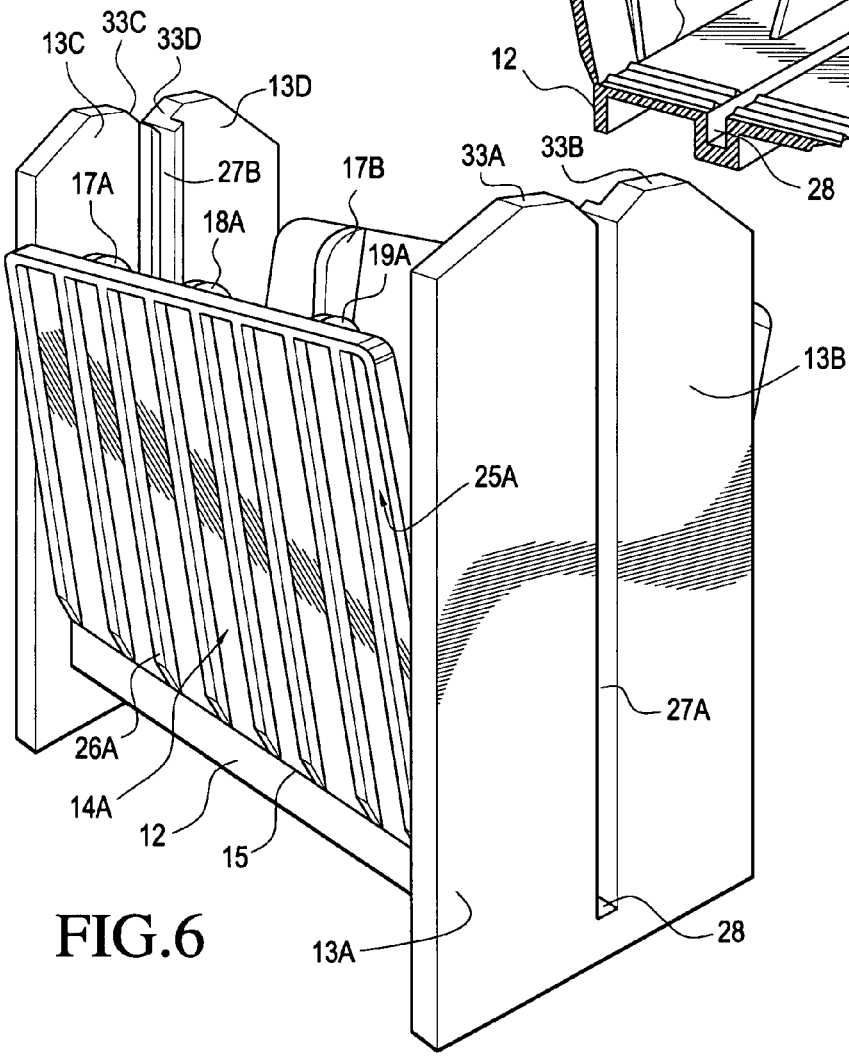
FIG. 6 is a perspective view of an alternate embodiment of the invention.

This invention pertains to a Squeeze-N-Slice™ bagel cutter 10, shown in FIG. 1 which allows one to slice a bagel 11 evenly, safely, and with ease. The bagel cutter 10 comprises a base 12 and upwardly extending end portions 13*a* and 13*b* at one end and 13*c* and 13*d* at the other end. A pair of spaced opposing sides 14*a*, 14*b* extend between the end portions 13*a*, 13*b* and 13*c*, 13. The sides 14*a*, 14*b* are each pivotally mounted to the base 12 at 15 and 16 respectively. The bagel cutter 10 may be molded in one piece from plastic or may comprise separate elements fastened together as shown in FIG. 6.

The two opposing sides 14*a* and 14*b* each have three protruding ribs 17*a*, 18*a* and 19*a* and 17*b*, 18*b* and 19*b* on the interior surfaces 21, 22 to prevent a bagel 11 from sliding out of the holder 10 while it is being cut. The ribs 17*a*, 18*a*, 19*a* and 17*b*, 18*b* and 19*b* (not shown) extend from the respective edges 23*a* and 23*b* in an outward curve 32 tapering to the base of side 14*a* or 14*b*. The opposing sides 14*a* and 14*b* are flexible so that one can obtain a firm grip on the bagel 11 by squeezing the two sides 14*a*, 14*b* together. The tops 23*a*, 23*b* of the flexible sides 14*a*, 14*b* are normally angled outward from the base 12 so there is more interior space at the top of the cutter or holder 10 than at the bottom. The angled sides 14*a*, 14*b* center the bagel 11 so that it may be cut into equal halves while allowing virtually any size bagel or roll 11 to fit into the bagel cutter 10. The outside surfaces 25*a*, 25*b* of the two flexible sides 14*a*, 14*b* include a plurality of ridges 26*a*, 26*b* and projecting upper edges 23*a* and 23*b* to permit a firmer grip by one's hand 50 while the bagel 11 is being cut with the other hand 51.

Two knife slots 27*a* and 27*b* extend vertically one at each end portion between 13*a* and 13*b* and between 13*c* and 13*d* at the other end above flexible sides 14*a*, 14*b* holding the bagel 11. Thus, the knife slots 27*a*, 27*b* extend above the top of the bagel 11 to allow placement of the knife 30 in the knife slots 27*a*, 27*b* before one grasps the two flexible sides 14*a*, 14*b* and squeezes them together to hold the bagel 11 for slicing.

The base 12 includes a recessed slot 28 running along the inside center of the base 12 aligned with the knife slots 27*a*, 27*b* so the knife 30 can cut completely through the bottom of the bagel 11 in a safe and expeditious manner.

Each of the end portions 13*a–d* include a triangular rib 31*a–d* (a and b not shown) extending downwardly from a mid-point to the base 12. The ribs 31*a–d* serve two purposes—providing strength and rigidity to the end portions 13*a–d* and serving to center the bagel 11 in the holder 10. The upper edge 33*a–d* of the end portions 13*a–d* is sloped to facilitate entry of a knife into the space 27*a*, 27*b*.

In operation, one simply inserts a bagel 11 into the holder 10 where it is guided into position by the ribs 31*a–d*. The knife 30 is then positioned in the slots 27*a* and 27*b* over the bagel 11. The two flexible sides 14*a* and 14*b* are squeezed together with one hand while holding the knife 30 and slicing through the bagel 11 held in place by the ribs 17*a*, 18*a*, 19*a* and 17*b*, 18*b*, 19*b*. The knife cuts totally through the bagel 11 as the knife 30 passes into the slot 28.

While the device is described with respect to bagels 11, it can also be used to cut rolls and similar food products.

While the invention has been explained by a detailed description of certain specific embodiments, it is understood that various modifications and substitutions can be made in any of them within the scope of the appended claims, which are intended also to include equivalents of such embodiments.

What is claimed is:

1. A device for holding and slicing bagels with a knife comprising:

an elongated base having a first end, a second end and a base slot extending into the base and axially therealong from the first end to the second end;

end portions extending vertically upward from the base at the first end and the second end, said end portions each comprising a pair of spaced members having a knife slot therebetween extending downwardly into the base slot to permit passage of a knife;

a pair of spaced opposing flexible side members each having a substantially rectangular configuration and being pivotally attached to the base at a bottom end of said side member and extending between the end portions of the base, said end portions extending higher from the base than the side members, said side members having inner and outer surfaces, with tapered, ribbed gripping means on the inner surfaces extending and tapering from a top end to the bottom end of the side members to securingly engage a bagel and ribbed gripping means on the outer surface to facilitate gripping and squeezing the side members into engagement with the bagel and wherein said side members are angled outwardly from the base to facilitate entry and centering of a bagel of any size; and, wherein a bagel is held by the tapered, ribbed inner gripping means when the flexible side members are squeezed together and a knife slices the bagel, passing through the knife slots between the respective end portions into the base slot.

2. A device for holding and slicing bagels in accordance with claim 1 wherein:

the device is a one piece molded plastic unit.

3. A device for holding and slicing bagels in accordance with claim 2 wherein:

the end portions each include triangular guide members extending downwardly from the end portion to the base to guide a bagel into position between the side members.

4. A device for holding and slicing bagels in accordance with claim 2 wherein:

the gripping means on the inner surface of the side members comprises a plurality of tapered spaced ribs on the opposing surfaces thereof.

5. A device for holding and slicing bagels in accordance with claim 4 wherein:

the spaced ribs curve outwardly from the side member and then taper to the base.

6. A device for holding and slicing bagels in accordance with claim 2 wherein:

the gripping means on the outer surfaces of the side members comprises a plurality of spaced ribs and an outwardly projecting outer surface on the upper portion thereof to permit gripping said members to squeeze a bagel between the side members.

7. A device for holding and slicing bagels in accordance with claim 2 wherein:

the end members each include an upper surface, said surface being sloped to facilitate entry or a knife in the space knife slot between the end members at each end.

8. A device for holding and slicing bagels in accordance with claim 1 wherein:

the side members each include a lower elongated edge attached to the base with the side member extending cantilevered upwardly therefrom.

* * * * *